US008382644B1

(12) United States Patent
Suprun

(10) Patent No.: US 8,382,644 B1
(45) Date of Patent: Feb. 26, 2013

(54) DEVICE FOR DIAPHRAGMAL RESISTIVE BREATHING TRAINING

(76) Inventor: Anton E. Suprun, Novosibirsk (RU)

( * ) Notice: Subject to any disclaimer, the term of this patent is extended or adjusted under 35 U.S.C. 154(b) by 383 days.

(21) Appl. No.: 12/904,184

(22) Filed: Oct. 14, 2010

Related U.S. Application Data

(63) Continuation-in-part of application No. 12/617,738, filed on Nov. 13, 2009, now abandoned.

(51) Int. Cl.
*A63B 21/00* (2006.01)

(52) U.S. Cl. ..... 482/13; 128/200.24; 128/200.26; 128/205.24; 600/532; 600/538

(58) Field of Classification Search ..... 128/200.24, 128/200.26, 201.11, 201.26, 201.27, 205.24; 600/532, 538; 482/13
See application file for complete search history.

(56) References Cited

U.S. PATENT DOCUMENTS 793,177 A * 6/1905 Caddy ..... 600/540
3,720,202 A * 3/1973 Cleary ..... 600/540
4,232,683 A * 11/1980 Bartholomew et al. ..... 600/538
4,259,951 A * 4/1981 Chernack et al. ..... 128/200.14
4,444,202 A * 4/1984 Rubin et al. ..... 600/538
4,693,256 A * 9/1987 Talonn ..... 600/538
6,986,745 B2 * 1/2006 Farr et al. ..... 600/533

* cited by examiner

*Primary Examiner* — Jerome W Donnelly
(74) *Attorney, Agent, or Firm* — Bardmesser Law Group

(57) ABSTRACT

A training device for diaphragmal breathing exercises, the device including (a) a beaker having a substantially cylindrical shape, with a bottom on one end and an opening on the other end; (b) an inner chamber within the beaker, the inner chamber having a bottom end and an open end on the same side as the open end of the beaker; (c) a lid having inner and outer circumferential ridges, wherein the lid fittingly mounts over the open end of beaker using an outer ridge and fittingly mounts over the inner chamber using the inner ridge; and (d) the lid further having a tubular coupling portion. A breathing tube is fittingly coupled to the tubular coupling portion on one end. A mouthpiece mounted on the other end of the breathing tube. The bottom end of the inner chamber has a stepped shape with a plurality of openings on each step. The lid has a plurality of openings.

19 Claims, 7 Drawing Sheets

102

DEVICE FOR DIAPHRAGMAL RESISTIVE BREATHING TRAINING

CROSS-REFERENCE TO RELATED APPLICATIONS

This application is a continuation-in-part of application Ser. No. 12/617,738, filed on Nov. 13, 2009, which is incorporated herein by reference in its entirety.

BACKGROUND OF THE INVENTION

1. Field of the Invention

The present invention is related to a system for weight loss, and more particularly, to a device for respiratory exercises with resistance, including a device for various respiratory phases and creation of resistance to a breathing process.

2. Description of the Related Art

Individuals that have excess body weight frequently exhibit various respiratory abnormalities, such as hypoventilation (insufficient air flow through the lungs) and breathing abnormalities during sleep. The excess body weight makes the normal functioning of the lungs mechanically more difficult. The presence of excess fatty tissues in the area of chest cavity or intrathoracic space reduces the ability of the lungs to expand fully. It creates a need for strenuous respiration and leads to a decrease of the vital capacity of the lungs and to a decrease of lung ventilation.

Respiratory muscles cannot perform the work required when the need for lung ventilation increases because of a mechanical restriction created by the excess mass of fatty tissues. The ventilation of pulmonary alveoli decreases because of superficial and inefficient respiration, and the total volume of air inhaled and exhaled decreases as well.

An excess weight leads to an increase of intra-abdominal pressure that leads to a higher than normal position of a diaphragm and to a decrease in lung capacity. The air exchange passages are narrowed and pulmonary gas exchange surfaces decrease, which leads to decrease in the level of oxygen absorption. The increase in intra-abdominal pressure necessitates higher than normal increase in the pressure necessary for the lung tissue to stretch and expand fully during the breathing process.

Due to the above abnormalities, people with excess weight have a lowered ability of their breathing apparatus to adapt and to compensate under the stress of physical exercise. The excess body weight increases the oxygen need in the body, but the respiratory muscles cannot perform the necessary work because of the mechanical restriction imposed by the fatty tissues. Chronic shortage of oxygen leads to general retardation of metabolism in the body and to further increase in the body weight.

Exercises involving diaphragmal respiration with resistance during the exhalation stage eliminate functional disorders of the breathing process and the gaseous metabolism that develop during accumulation of excess body mass. Such exercises promote normalization of body metabolism and weight reduction.

Accordingly, there is a need in the art for a device for efficient delivery to the lungs of additional volume of oxygen that would accelerate the oxidation of fats, leading to reduction of the volume of fat in the tissues and to decrease in excess body weight.

SUMMARY OF THE INVENTION

The present invention is intended as a method and system for reduction of excess body weight. An exemplary embodiment provides a special three-phase diaphragmal respiration exercise performed in a special mode. The exemplary method employs interrelation of phases of inhalation, inspiratory pause and exhalation. Thus, respiration is carried out under conditions of an additional respiratory resistance during the exhalation phase during the exercise.

A training device for diaphragmal breathing exercises including (a) a beaker having a substantially cylindrical shape, with a bottom on one end and an opening on the other end; (b) an inner chamber within the beaker, the inner chamber having a bottom end and an open end on the same side as the open end of the beaker; (c) a lid having inner and outer circumferential ridges, wherein the lid fittingly mounts over the open end of beaker using an outer ridge and fittingly mounts over the inner chamber using the inner ridge; and (d) the lid further having a tubular coupling portion. A breathing tube is fittingly coupled to the tubular coupling portion on one end. A mouthpiece mounted on the other end of the breathing tube. The bottom end of the inner chamber has a stepped shape with a plurality of openings on each step. The lid has a plurality of openings.

Additional features and advantages of the invention will be set forth in the description that follows, and in part will be apparent from the description, or may be learned by practice of the invention. The advantages of the invention will be realized and attained by the structure particularly pointed out in the written description and claims hereof as well as the appended drawings.

It is to be understood that both the foregoing general description and the following detailed description are exemplary and explanatory and are intended to provide further explanation of the invention as claimed.

BRIEF DESCRIPTION OF THE ATTACHED FIGURES

The accompanying drawings, which are included to provide further understanding of the invention and are incorporated in and constitute a part of this specification, illustrate embodiments of the invention and, together with the description, serve to explain the principles of the invention.

DETAILED DESCRIPTION OF THE PREFERRED EMBODIMENTS

Figure 1:
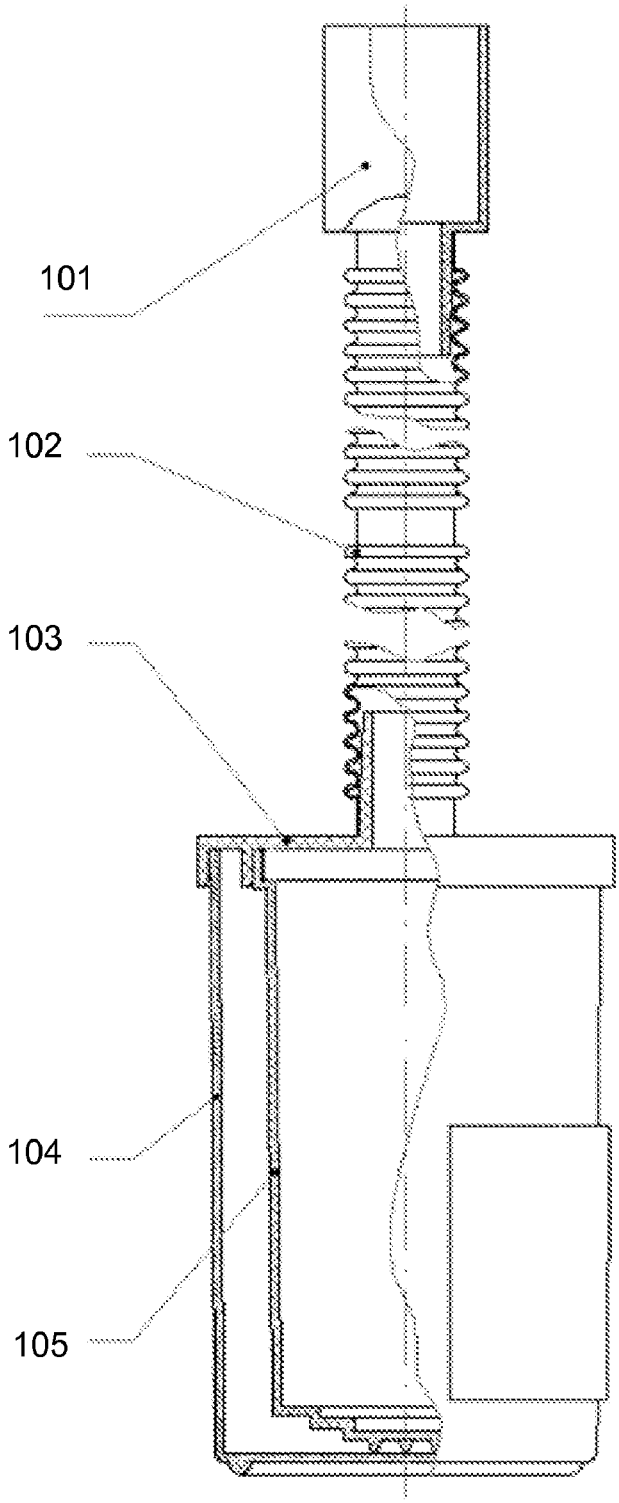
FIG. 1 shows the breathing exercise device 100 in assembled form.

Reference will now be made in detail to the preferred embodiments of the present invention, examples of which are illustrated in the accompanying drawings.

In one embodiment of the invention, the diaphragmal respiration is performed, during which, at inhalation, the diaphragm is brought downward, the lungs are stretched out and the frontal abdominal wall moves forward. During the exhalation phase, the frontal abdominal wall is brought inward, and, thus, the diaphragm returns to its starting position. During the exhalation phase an additional respiratory resistance is created.

While breathing in accordance with the above methodology is performed, certain proportions of phases of a respiratory cycle are observed. At the beginning of training, according to one exemplary embodiment, the inhalation phase is performed for a period of 3 seconds (or 2.5-3.5 seconds), followed by a pause after the inhalation for a period of 3 seconds (or 2.5-3.5 seconds), followed by a slow exhalation with resistance for a period of 4 seconds (or 3-5 seconds). An arbitrary number of seconds can be used in the same proportion.

As the training continues, the functioning of the diaphragm is improved and the ventilation of the lungs is enhanced. Thus, the duration of each phase of the breathing exercise is increased. The inhalation phase is performed for a period of up to 5 seconds (or 4-6 seconds), followed by a pause after the inhalation for a period of up to 5 seconds (or 4-6 seconds), followed by exhalation for a period of 10-15 seconds. Note that a different number of seconds can be used in the same proportion, depending on individual lung capacity.

The respiratory resistance, in accordance with the exemplary embodiment, can be achieved by using various mechanical devices. For example, water at room temperature is poured into a container with transparent walls to a certain level (for example, 55 mm). A straw or a tube (for example, 250 mm in length and 10 mm in diameter) is lowered into the water. The lower end of the straw is placed above the bottom of the container (for example, at 5 mm off the bottom). The other free end of the straw is tightly held by lips of a user.

The inhalation is slowly performed through the nose for a short period (for example 3 to 5 seconds), followed by a pause (apnea) for an equal period. After this inspiratory pause, the air is exhaled slowly for a longer time period (for example, 10-15 seconds) through the straw placed into the container with water.

The process of exhalation is controlled visually by observing the air bubbles formed in the layer of water. During this training exercise example, a certain resistance to exhalation is created, equaling approximately to the pressure created by a 50 mm column of water (i.e., equal to approximately 3.7 mm of mercury). This provides additional increase of pressure in the lungs at physiologically safe level equal approximately to 0.05 atmospheres. Note that exhaling resistance can be adjusted by changing a position of the straw in a vertical plane. Putting the straw deeper increases the exhaling resistance while moving it up decreases the exhaling resistance. Additionally, the amount of water in the container can be increased.

In order to implement the proposed method, other mechanical devices can be used for creating resistance to exhalation within defined physiological limits. The duration of one exercise session during the first week of training should be about 10 minutes, during the second week—15 minutes, and during the third week and thereafter—20-25 minutes.

The recommended training frequency during the first week of training is one session per day and during the second week and thereafter—two sessions per day. Those skilled in the art will appreciate that performance of the diaphragmal respiration exercise, according to the proposed methodology, improves the ventilation of the lungs, since the slow inhalation with an active movement of the diaphragm promotes an increase in the amplitude of movement of the diaphragm to physiologically normal.

It also improves the expansion of the lungs, especially in the main regions, and allows engaging into the respiratory process the respiratory passages with insufficient aeration and improves the conditions for influx of oxygen from the lungs into the blood. This type of inhalation also improves the circulation of blood and lymph in the lungs and in the rest of the body.

A pause in respiration after inhaling (inspiratory pause) stabilizes intrapulmonic pressure in all regions of the lungs, which creates conditions for a comfortable (at the physiological level) performance of subsequent exhalation with resistance after the inspiratory pause. Using an inspiratory pause after the diaphragmal inhalation increases the time the blood spends in contact with oxygen in the alveoli, increases the time the oxygen is absorbed into the blood and increases the level of saturation of blood with oxygen.

The exhalation with resistance phase results in moderate increase of the intrapulmonic pressure from resistance to exhalation from the water. This improves the uniformity of ventilation of all regions of the lungs, promotes augmentation of ventilation of the alveoli, increases the area of gaseous exchange in the lungs between the air and the blood, and, accordingly, increases the influx of oxygen into blood and histic respiration (the use of oxygen for full oxidation of the lipids).

Training in the three-phase respiration in the prescribed manner, with a specific, regulated interrelation of the duration of the three phases: inhalation, inspiratory pause and exhalation, preserves the natural, physiologically normal character of the respiratory cycle. This also allows balancing the influence of various phases of the respiratory cycle on sympathetic and parasympathetic nervous system, which, in turn, has a positive influence on various metabolic processes.

As a result of trainings in three-phase diaphragmal respiration with resistance for two months, the correct stereotype of respiration is developed. Additionally, the physiological reserves of the respiratory system are increased by 15-20%, the activity of the respiratory processes and the lipolysis increase as well. This promotes the utilization of the fatty tissues and increases aerobic efficiency, which results in natural weight loss similar to aerobic activity.

Figure 2:
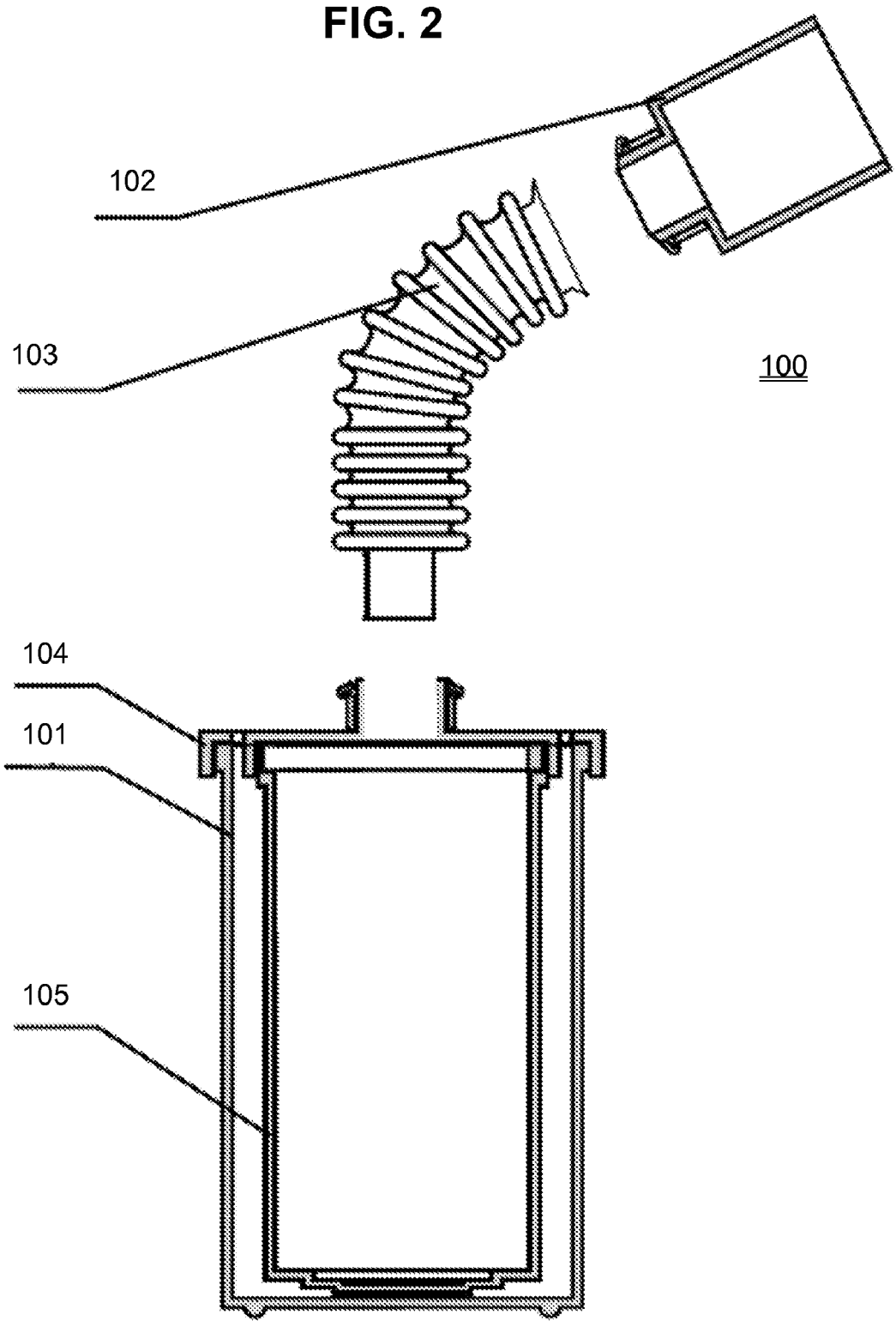
FIG. 2 shows the device 100 in partially disassembled form.
Figure 3:
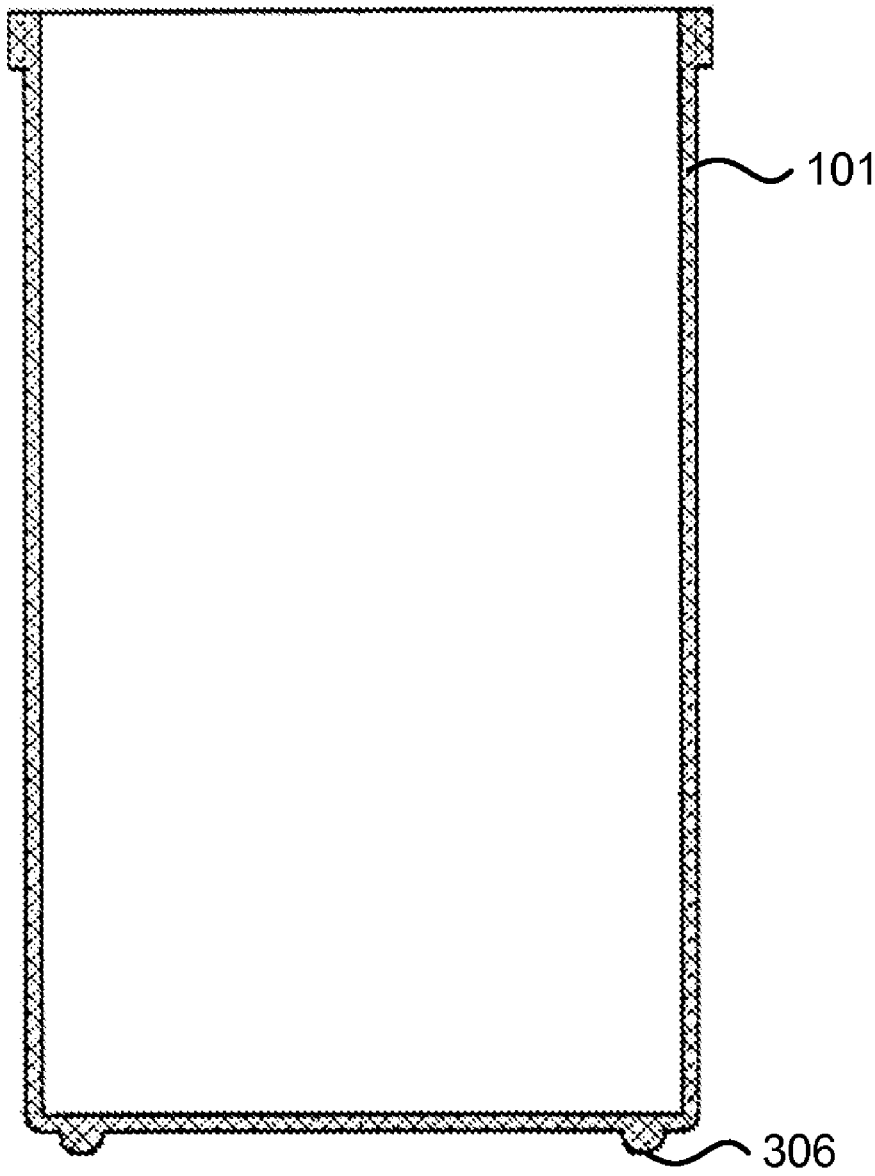
FIG. 3 shows a cross sectional illustration of the beaker used to enclose the inner chamber and the water contained therein.
Figure 4:
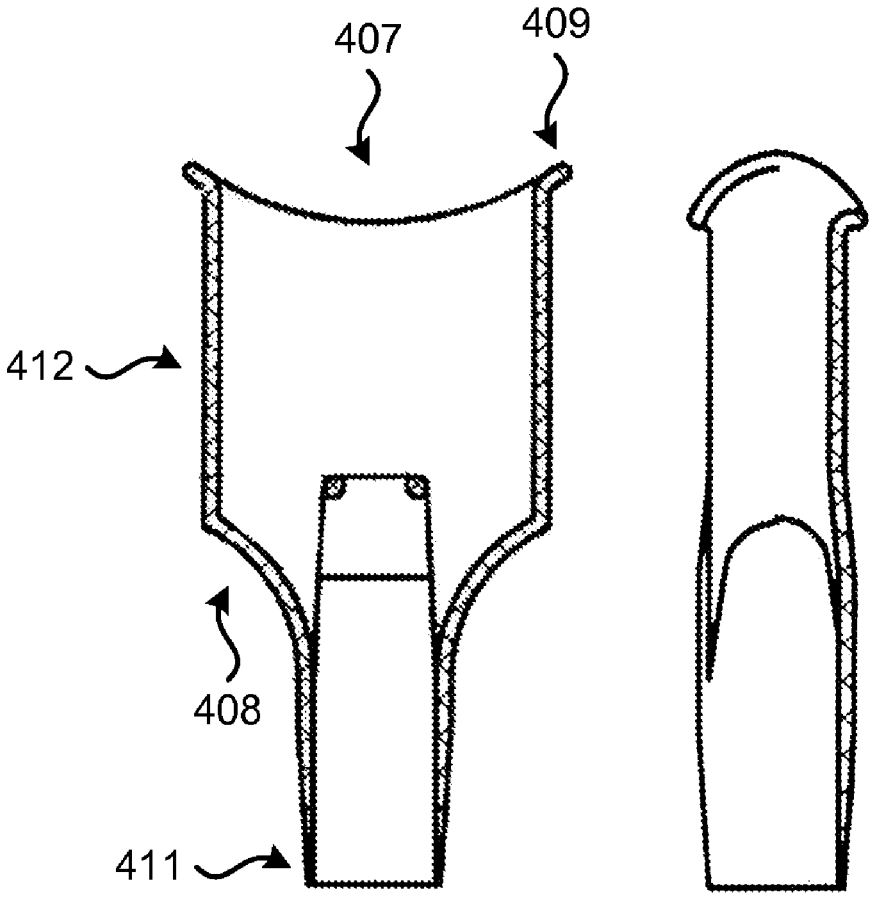
FIG. 4 illustrates the mouthpiece.
Figure 5:
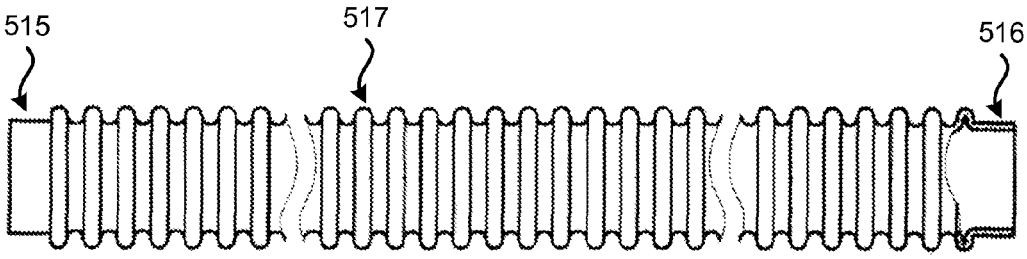
FIG. 5 illustrates the breathing tube.
Figure 6:
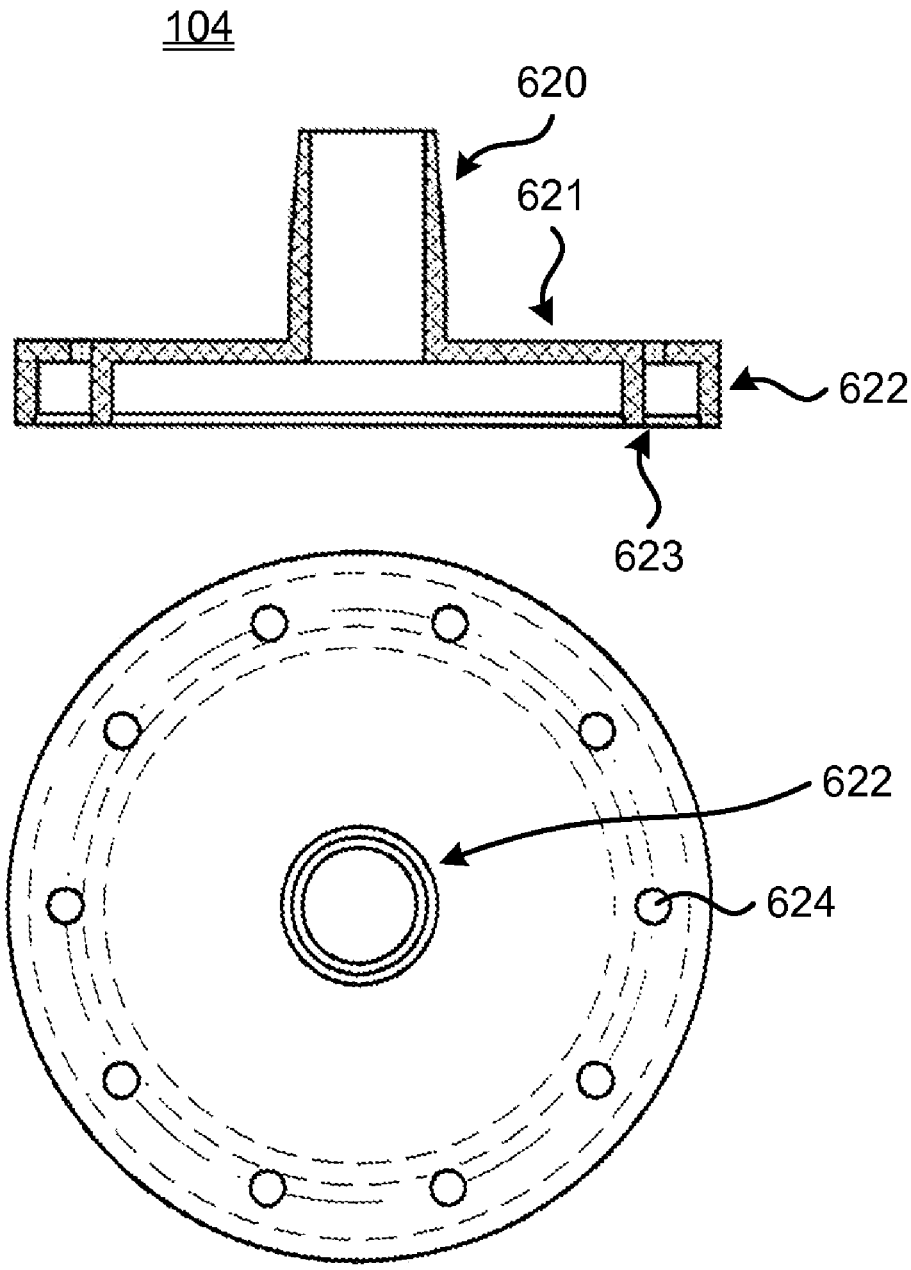
FIG. 6 illustrates the lid.
Figure 7:
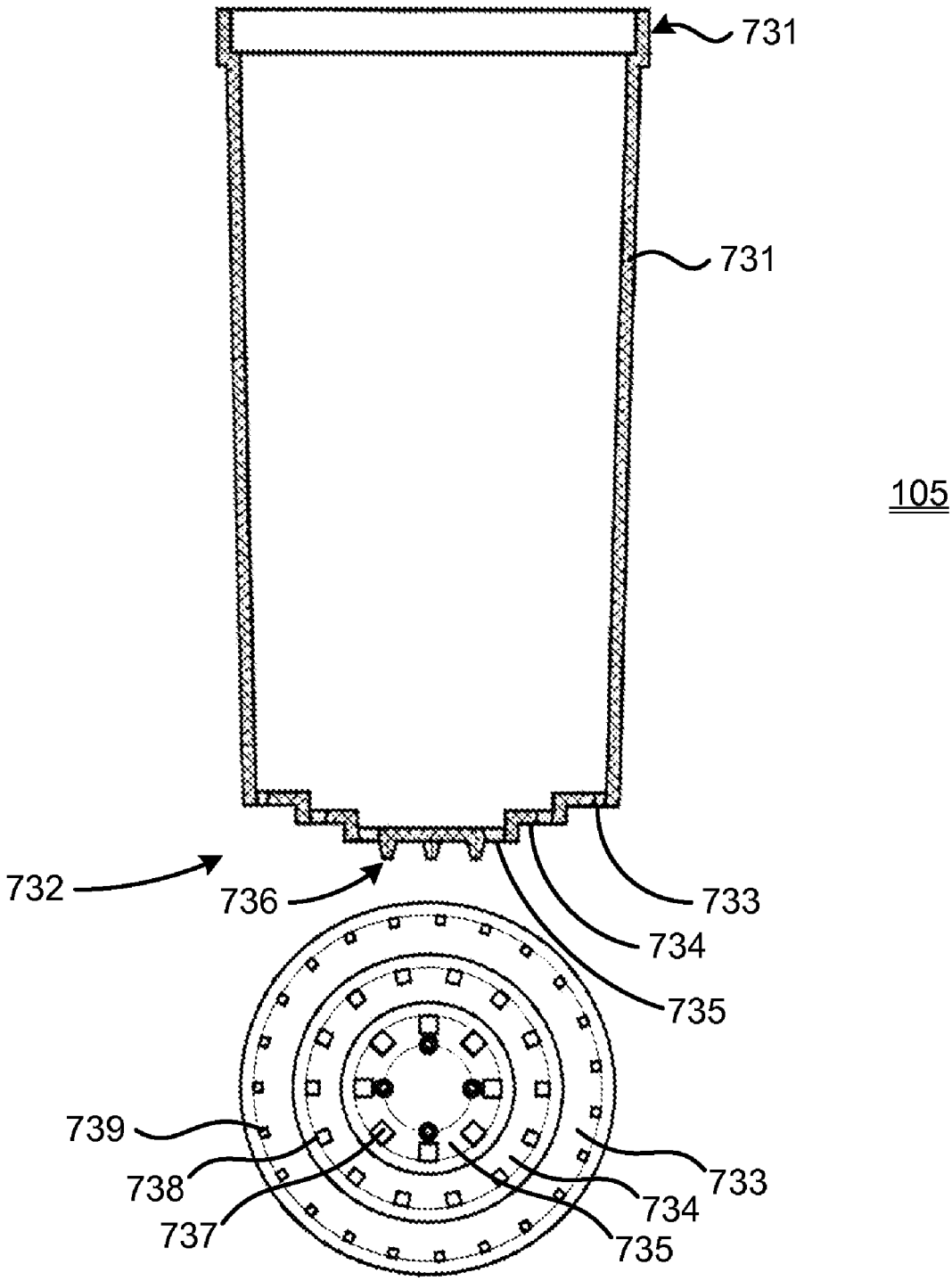
FIG. 7 illustrates the inner chamber.

One embodiment of the breathing exercise training device is shown in FIGS. 1-7. FIG. 1 shows the breathing exercise device 100 in assembled form. FIG. 2 shows the device 100 in partially disassembled form. FIG. 3 shows a cross sectional illustration of the beaker used to enclose the inner chamber and the water contained therein. FIG. 4 illustrates the mouthpiece. FIG. 5 illustrates the breathing tube. FIG. 6 illustrates the lid. FIG. 7 illustrates the inner chamber.

As shown in FIG. 1, the breathing exercise training device 100, in assembled form, includes a beaker 104 that encloses an inner chamber 105. A lid 103 is fittingly mounted on top of the beaker 104. The lid 103 is coupled to a flexible breathing tube 102. A mouthpiece 101 is fittingly attached to the breathing tube 102. Note that the breathing tube 102 is not shown to scale in these figures.

FIG. 2 illustrates the breathing exercise training device 100 in disassembled form. The mouthpiece 102 and the breathing tube 103 can be detached from the lid 104. Also, not shown in this figure, the lid 104 can be removed from the beaker 101, and the inner chamber 105 can also be removed.

FIG. 3 illustrates a cross section of the beaker 101. In the preferred embodiment, the beaker 101 is made of transparent or semi-transparent material, so that the user, while filling the beaker 101 with liquid and while performing the breathing exercises, can see how much water is in the beaker 101, and the level of the water at the moment of inhalation and exhalation.

As further shown in FIG. 3, the beaker 101 has a bottom ridge 306, which is arranged substantially circumferentially around the bottom of the beaker 101. The beaker 101 also has a optional lip 307, which is generally used to improve the coupling between the beaker 101 and the lid 104. In the preferred embodiment, the beaker 101 is substantially cylindrical in shape, and is axially symmetric about its central axis. However, other shapes are possible, such as a roughened surface, a conical shape (for example, narrower towards the bottom compared to the top, and so on).

FIG. 4 illustrates one embodiment of the mouthpiece 102. As shown in FIG. 4, the mouthpiece 102 includes an arcuate portion 407 bounded by a lip 409, which will normally be in contact with the user's mouth. The mouthpiece 102 also includes a flat portion 412, a generally tubular portion 411, which is intended for coupling to the breathing tube 103. The tubular portion 411 generally becomes wider using an arcuate portion 408, as shown in this figure.

FIG. 5 illustrates an embodiment of the breathing tube 103. As shown in FIG. 5, the breathing tube 103 includes coupling portions 515 and 516, for coupling to the lid 104 and the mouthpiece 101. The breathing tube is generally intended to be flexible, for example, it should easily bend at least 90°, to provide the user with a comfortable experience while performing the breathing exercises. The breathing tube includes ridges 517 along its length, which enable the tube, which is generally made of plastic or similar material, to bend without permanent deformation.

FIG. 6 illustrates the lid 104. As shown in FIG. 6, the lid 104 includes a top surface 621 and a tubular coupling portion 620, for fittingly mounting the breathing tube 103. The lid 104 also includes two flanges (ridges) 622 and 623, for fittingly coupling to the beaker 105 during operation. FIG. 6 includes a side cross sectional view and a top view of the lid 104.

The lid 104 also includes a plurality of openings 624. In a typical embodiment, the openings 624 are generally positioned circumferentially around the surface 621. In a typical embodiment, there could be between 6 and 10 such openings 624.

FIG. 7 illustrates the inner chamber 105. The inner chamber 105 includes an upper rim/step portion 731. The body 730 of the inner chamber 105, in the preferred embodiment, is slightly conical (in the preferred embodiment, roughly 5-10°), and includes a bottom surface 732 which is in the form of cylindrical steps, labeled 733, 734 and 735. The surfaces of the steps 733, 734 and 735 include a number of openings 739, 738 and 737, respectively. The openings are typically arranged circumferentially on each step surface. Additionally, the bottom surface 732 has at least one, and typically 2-4 protrusions 736, which prevent the bottom 732 from contacting the bottom surface of the beaker 101 more than it has to, and thereby assisting the user in maintaining pressure while performing the breathing exercises.

During the exercises, the principal of utilizing positive expiratory pressure is utilized. To achieve this, the user experiences resistance to the breathing in a physiologically safe range, for example, 0.5 kilopascals (+/−50%). The stepped bottom surface 732 of the inner chamber 105 assists formation of an even airflow through a layer of water, so that the user can gradually experience rising resistance to his breathing (and therefore rising air pressure in his lungs) during the process of exhalation. This permits avoiding sharp changes in air pressure within the lungs, and undesirable physiological reactions. In a typical embodiment, the length of the breathing tube is approximately 230 millimeters (+−50 millimeters). The diameter of the breathing tube is typically between 14 and 16 millimeters. The outer diameter (including the ridges 517, is typically approximately 20 millimeters. The radius of the arcuate surface 407, in a typical embodiment, is approximately 50 millimeters. The mouthpiece 102 is approximately 35-40 millimeters in its widest dimension (on the left illustration in FIG. 4). In the exemplary embodiment, FIG. 4 is shown roughly to scale, as far as its relative dimensions are concerned.

The beaker 105, in a typical embodiment, is approximately 60-65 millimeters in its widest dimension. The inner diameter of the beaker 101, in a typical embodiment, is between 55 and 65 millimeters. The bottom ridge 306 is typically about 1-2 millimeters in radius, and is approximately 57 millimeters in diameter on the bottom surface of the beaker 101.

The outer radius, at its widest dimension, of the inner chamber 105, in a typical embodiment, is between 45 and 50 millimeters. The height of the inner chamber, at its largest dimension, is typically between 90 and 100 millimeters. The diameter of the bottom surface 732 is typically between 40 and 45 millimeters. The height of the protrusions 736, in a typical embodiment, is approximately between 1.5 and 2.5 millimeters. The radius of the innermost step 735, in a typical embodiment, is approximately 29-32 millimeters.

Having thus described a preferred embodiment, it should be apparent to those skilled in the art that certain advantages of the described method and apparatus can be achieved. It should also be appreciated that various modifications, adaptations and alternative embodiments thereof may be made within the scope and spirit of the present invention. The invention is further defined by the following claims.

What is claimed is:

1. A training device for diaphragmal breathing exercises, the device comprising:

(a) a beaker having a substantially cylindrical shape, with a bottom on one end and an opening on the other end;

(b) an inner chamber within the beaker, the inner chamber having a bottom end and an open end on the same side as the open end of the beaker;

(c) a lid having inner and outer circumferential ridges, wherein the lid fittingly mounts over the open end of beaker using an outer ridge and fittingly mounts over the inner chamber using the inner ridge; and (d) the lid further having a tubular coupling portion;

(e) a breathing tube fittingly coupled to the tubular coupling portion on one end;

(f) a mouthpiece mounted on the other end of the breathing tube, wherein the bottom end of the inner chamber has a stepped shape with a plurality of openings on each step, and wherein the lid has a plurality of openings.

2. The device of claim 1, wherein the plurality of openings of the lid are arranged circumferentially and equiangularly.

3. The device of claim 1, wherein the mouthpiece has an arcuate-shaped portion.

4. The device of claim 1, wherein the stepped bottom portion of the inner chamber has three steps.

5. The device of claim 4, wherein each of the steps has a plurality of openings.

6. The device of claim 5, wherein the openings of each step are arranged circumferentially.

7. The device of claim 1, wherein the bottom of the inner chamber has at least one protrusion.

8. The device of claim 1, wherein the breathing tube is flexible and is capable of bending at least 90 degrees.

9. The device of claim 1, wherein the breathing tube has a plurality of ridges along its length.

10. The device of claim 1, wherein the beaker is at least partially transparent.

11. A kit for diaphragmal breathing exercises, the kit comprising:

(a) a beaker having a substantially cylindrical shape, with a bottom on one end and an opening on the other end;

(b) an inner chamber within the beaker, the inner chamber having a bottom end and an open end, wherein the bottom end of the inner chamber has a stepped shape with a plurality of openings on each step;

(c) a lid having inner and outer circumferential ridges, wherein the lid is adapted to fittingly mount over the open end of beaker using an outer ridge and adapted to fittingly mount over the inner chamber using the inner ridge, the lid further having a tubular coupling portion and lid has a plurality of openings;

(e) a breathing tube adapted to fittingly couple to the tubular coupling portion on one end; and (f) a mouthpiece adapted to fittingly mount on the other end of the breathing tube.

12. The kit of claim 11, wherein the plurality of openings of the lid are arranged circumferentially and equiangularly.

13. The kit of claim 11, wherein the mouthpiece has an arcuate-shaped portion.

14. The kit of claim 11, wherein the stepped bottom portion of the inner chamber has three steps.

15. The kit of claim 14, wherein each of the steps has a plurality of openings.

16. The kit of claim 15, wherein the openings of each step are arranged circumferentially.

17. The kit of claim 11, wherein the bottom of the inner chamber has at least one protrusion.

18. The kit of claim 11, wherein the breathing tube is flexible and is capable of bending at least 90 degrees.

19. The kit of claim 11, wherein the breathing tube has a plurality of ridges along its length.

* * * * *